US010309195B2

(12) United States Patent
Tolman et al.

(10) Patent No.: US 10,309,195 B2
(45) Date of Patent: Jun. 4, 2019

(54) SELECTIVE STIMULATION PORTS INCLUDING SEALING DEVICE RETAINERS AND METHODS OF UTILIZING THE SAME

(71) Applicants: Randy C. Tolman, Spring, TX (US); P. Matthew Spiecker, Manvel, TX (US); Steve Lonnes, Spring, TX (US); Timothy J. Hall, Houston, TX (US)

(72) Inventors: Randy C. Tolman, Spring, TX (US); P. Matthew Spiecker, Manvel, TX (US); Steve Lonnes, Spring, TX (US); Timothy J. Hall, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 162 days.

(21) Appl. No.: 15/340,587

(22) Filed: Nov. 1, 2016

(65) Prior Publication Data

US 2017/0159407 A1 Jun. 8, 2017

Related U.S. Application Data

(60) Provisional application No. 62/411,004, filed on Oct. 21, 2016, provisional application No. 62/263,067, filed on Dec. 4, 2015.

(51) Int. Cl.

| | |
|---|---|
| ***E21B 34/08*** | (2006.01) |
| ***E21B 43/25*** | (2006.01) |
| ***E21B 33/138*** | (2006.01) |

(52) U.S. Cl.

CPC ..... *E21B 34/08* (2013.01); *E21B 33/138* (2013.01); *E21B 43/25* (2013.01)

(58) Field of Classification Search

CPC ..... E21B 34/08; E21B 34/063

See application file for complete search history.

(56) References Cited

U.S. PATENT DOCUMENTS

| | | |
|---|---|---|
| 3,167,122 A | 1/1965 | Lang |
| 3,450,203 A | 6/1969 | Patron et al. |

(Continued)

FOREIGN PATENT DOCUMENTS

| | | |
|---|---|---|
| AU | 2015 201029 | 3/2015 |
| WO | WO 2003/002849 | 1/2003 |

(Continued)

OTHER PUBLICATIONS

Halliburton, "*Illusion Frac Plug*,"downloaded from http://www.halliburton.com/en-US/news/announcements/halliburton-introduces-illusion-frac-plug.page?node-id=hgeystfs, Jun. 15, 2015, p. 1.

*Primary Examiner* — D. Andrews

(74) *Attorney, Agent, or Firm* — ExxonMobil Upstream Research Company-Law Department

(57) ABSTRACT

Selective stimulation ports including sealing device retainers and methods of utilizing the same are disclosed herein. The selective stimulation ports (SSPs) are configured to be operatively attached to a wellbore tubular that defines a tubular conduit. The SSPs include an SSP conduit, which extends at least substantially perpendicular to a wall of the wellbore tubular, and a sealing device receptacle, which defines at least a portion of the SSP conduit and is sized to receive a sealing device. The SSPs also include a sealing device seat, which is shaped to form a fluid seal with the sealing device. The SSPs further include a sealing device retainer, which is configured to retain the sealing device within the sealing device receptacle. The methods include methods of stimulating the hydrocarbon well utilizing the SSPs and/or methods of conveying a downhole tool within the hydrocarbon well utilizing the SSPs.

23 Claims, 7 Drawing Sheets

(56) References Cited

U.S. PATENT DOCUMENTS

| | | | |
|---|---|---|---|
| 5,234,055 | A | 8/1993 | Cornette |
| 5,579,844 | A | 12/1996 | Rebardi et al. |
| 5,704,426 | A | 1/1998 | Rytlewski et al. |
| 5,829,520 | A | 11/1998 | Johnson |
| 6,095,247 | A | 8/2000 | Streich et al. |
| 6,155,494 | A | 12/2000 | Fabbri et al. |
| 6,394,184 | B2 | 5/2002 | Tolman et al. |
| 6,543,538 | B2 | 4/2003 | Tolman et al. |
| 6,907,936 | B2 | 6/2005 | Fehr et al. |
| 6,957,701 | B2 | 10/2005 | Tolman et al. |
| 7,059,407 | B2 | 6/2006 | Tolman et al. |
| 7,168,494 | B2 | 1/2007 | Starr et al. |
| 7,353,879 | B2 | 4/2008 | Todd et al. |
| 7,357,151 | B2 | 4/2008 | Lonnes |
| 7,467,778 | B2 | 12/2008 | Lonnes |
| 7,477,160 | B2 | 1/2009 | Lemenager et al. |
| 7,516,792 | B2 | 4/2009 | Lonnes et al. |
| 7,575,062 | B2 | 8/2009 | East, Jr. |
| 7,735,559 | B2 | 6/2010 | Malone |
| 7,798,236 | B2 | 9/2010 | McKeachnie et al. |
| 8,167,047 | B2 | 5/2012 | Themig et al. |
| 8,215,411 | B2 | 7/2012 | Flores et al. |
| 8,220,542 | B2 | 7/2012 | Whitsitt et al. |
| 8,237,585 | B2 | 8/2012 | Zimmerman |
| 8,267,177 | B1 | 9/2012 | Vogel et al. |
| 8,276,670 | B2 | 10/2012 | Patel |
| 8,330,617 | B2 | 12/2012 | Chen et al. |
| 8,347,982 | B2 | 1/2013 | Hannegan et al. |
| 8,496,055 | B2 | 7/2013 | Mootoo et al. |
| 8,695,506 | B2 | 4/2014 | Lanclos |
| 2002/0007949 | A1 | 1/2002 | Tolman et al. |
| 2004/0016549 | A1 | 1/2004 | Selinger et al. |
| 2004/0084190 | A1 | 5/2004 | Hill et al. |
| 2006/0118301 | A1 | 6/2006 | East, Jr. et al. |
| 2007/0246211 | A1 | 10/2007 | Schneider et al. |
| 2008/0093073 | A1 | 4/2008 | Bustos et al. |
| 2008/0156498 | A1 | 7/2008 | Phi et al. |
| 2008/0296024 | A1 | 12/2008 | Huang et al. |
| 2009/0032255 | A1 | 2/2009 | Surjaatmadja et al. |
| 2009/0101334 | A1 | 4/2009 | Baser et al. |
| 2010/0084134 | A1 | 4/2010 | Tulissi et al. |
| 2010/0122817 | A1 | 5/2010 | Surjaatmadja et al. |
| 2011/0048743 | A1 | 3/2011 | Stafford et al. |
| 2011/0168403 | A1 | 7/2011 | Patel |
| 2012/0037366 | A1 | 2/2012 | Sherman |
| 2012/0043079 | A1 | 2/2012 | Wassouf et al. |
| 2012/0085548 | A1 | 4/2012 | Fleckenstein et al. |
| 2012/0090687 | A1 | 4/2012 | Grigsby et al. |
| 2012/0111566 | A1 | 5/2012 | Sherman et al. |
| 2012/0199349 | A1 | 8/2012 | Themig et al. |
| 2012/0292053 | A1 | 11/2012 | Xu et al. |
| 2013/0008648 | A1 | 1/2013 | Lovorn et al. |
| 2013/0062055 | A1 | 3/2013 | Tolman et al. |
| 2013/0062072 | A1 | 3/2013 | Alvarez et al. |
| 2013/0105159 | A1 | 5/2013 | Alvarez et al. |
| 2013/0199790 | A1 | 8/2013 | Themig et al. |
| 2013/0206425 | A1 | 8/2013 | Mazyar et al. |
| 2013/0248174 | A1 | 9/2013 | Dale et al. |
| 2013/0255939 | A1 | 10/2013 | Kumaran et al. |
| 2013/0292123 | A1* | 11/2013 | Murphree ..... E21B 34/14 166/308.1 |
| 2014/0131035 | A1 | 5/2014 | Entchev et al. |
| 2014/0246209 | A1 | 9/2014 | Themig et al. |
| 2014/0305877 | A1 | 10/2014 | Cioanta et al. |
| 2015/0176388 | A1 | 6/2015 | Tolman et al. |
| 2015/0285030 | A1 | 10/2015 | Tolman et al. |
| 2015/0315872 | A1* | 11/2015 | Phi ..... E21B 43/12 166/305.1 |
| 2016/0108711 | A1* | 4/2016 | Lynk ..... E21B 43/26 166/297 |

FOREIGN PATENT DOCUMENTS

| | | |
|---|---|---|
| WO | WO 2007/115051 | 10/2007 |
| WO | WO 2007/134598 | 11/2007 |
| WO | WO 2014/077949 | 5/2014 |
| WO | WO 2014/184587 | 11/2014 |
| WO | WO 2015/073030 | 5/2015 |

* cited by examiner

SELECTIVE STIMULATION PORTS INCLUDING SEALING DEVICE RETAINERS AND METHODS OF UTILIZING THE SAME

CROSS REFERENCE TO RELATED APPLICATIONS

This application claims the benefit of U.S. Provisional Application Ser. No. 62/411,004 filed Oct. 21, 2016, entitled "Selective Stimulation Ports Including Sealing Device Retainers And Methods Of Utilizing The Same," and benefit of U.S. Provisional Application Ser. No. 62/263,067 filed Dec. 4, 2015, entitled "Ball-Sealer Check-Valves for Wellbore Tubulars and Methods of Utilizing the Same," and is also related to U.S. patent application Ser. No. 15/264,052 filed Sep. 13, 2016; U.S. patent application Ser. No. 15/264,064 filed Sep. 13, 2016; U.S. Provisional Application Ser. No. 62/263,065 filed Dec. 4, 2015; U.S. patent application Ser. No. 15/264,076 filed Sep. 13, 2016; and U.S. Provisional Application Ser. No. 62/329,690 filed Apr. 29, 2016, the disclosures of each of which are incorporated herein by reference in their entireties.

FIELD OF THE DISCLOSURE

The present disclosure relates generally to selective stimulation ports and more particularly to selective stimulation ports that include and/or utilize sealing device retainers and/or to methods of utilizing the selective stimulation ports.

BACKGROUND OF THE DISCLOSURE

Hydrocarbon wells generally include a wellbore that extends from a surface region and/or that extends within a subterranean formation that includes a reservoir fluid, such as liquid and/or gaseous hydrocarbons. Often, it may be desirable to stimulate the subterranean formation, such as to enhance production of the reservoir fluid therefrom. Stimulation of the subterranean formation may be accomplished in a variety of ways and generally includes supplying a stimulant fluid to the subterranean formation to increase reservoir contact. As an example, the stimulation may include supplying an acid to the subterranean formation to acid-treat the subterranean formation and/or to dissolve at least a portion of the subterranean formation. As another example, the stimulation may include fracturing the subterranean formation, such as by supplying a fracturing fluid, which is pumped at a high pressure, to the subterranean formation. The fracturing fluid may include particulate material, such as a proppant, which may at least partially fill fractures that are generated during the fracturing, thereby facilitating flow of the reservoir fluid into the hydrocarbon well, via the fractures, after supply of the fracturing fluid has ceased.

A variety of systems and/or methods have been developed to facilitate stimulation of subterranean formations, and each of these systems and methods generally has inherent benefits and drawbacks. Many of these systems and methods utilize a shape-charge perforation gun to create perforations within a wellbore tubular that defines a tubular conduit and extends within the wellbore, and the stimulant fluid then is provided to the subterranean formation via the perforations. However, such systems suffer from a number of limitations. As an example, the perforations may not be round or may have burrs, which may make it challenging to seal the perforations subsequent to stimulating a given region of the subterranean formation. As another example, the perforations often will erode and/or corrode due to flow of the stimulant fluid, flow of proppant, and/or long-term flow of reservoir fluid therethrough.

As yet another example, a stimulation process may involve sealing perforations with a sealing device, such as a ball sealer, in order to facilitate stimulation of various zones, or regions, of the subterranean formation. In such a stimulation process, a pressure within the tubular conduit must be maintained higher than a pressure within the subterranean formation proximate the tubular conduit or the sealing devices may unseat from corresponding perforations, thereby unsealing the corresponding perforations. In some circumstances, it may be difficult to maintain the higher pressure within the tubular conduit, especially if the perforations are only partially sealed. Additionally or alternatively, unexpected events may cause the pressure within the tubular conduit to drop, thereby unseating the sealing devices from the corresponding perforations. Unseated sealing balls may be difficult to reseat on the corresponding perforations. Such events may be costly and/or time-consuming to mitigate. Thus, there exists a need for selective stimulation ports with preformed sealing device seats and sealing device retainers that are configured to retain sealing devices proximate the corresponding sealing device seats.

SUMMARY OF THE DISCLOSURE

Selective stimulation ports including sealing device retainers and methods of utilizing the same are disclosed herein. The selective stimulation ports (SSPs) have a conduit-facing region and a formation-facing region and are configured to be operatively attached to a wellbore tubular that defines a tubular conduit. The wellbore tubular is configured to extend within a wellbore that extends within a subterranean formation. The SSPs include an SSP conduit, which extends at least substantially perpendicular to a wall of the wellbore tubular, and a sealing device receptacle, which defines at least a portion of the SSP conduit and is sized to receive a sealing device. The SSPs also include a sealing device seat, which defines at least a portion of the SSP conduit, is defined within the sealing device receptacle, and is shaped to form a fluid seal with the sealing device. The SSPs further include a sealing device retainer, which is configured to retain the sealing device within the sealing device receptacle.

The methods include methods of stimulating the hydrocarbon well. These methods include pressurizing a wellbore tubular and opening a selected SSP of a plurality of SSPs, with the plurality of SSPs being spaced-apart along a length of the wellbore tubular. These methods also include flowing a first volume of stimulant fluid into the subterranean formation via an SSP conduit of the selected SSP and releasing a sealing device within the tubular conduit. These methods further include receiving the sealing device within a sealing device receptacle of the selected SSP and retaining the sealing device within the sealing device receptacle with a sealing device retainer of the selected SSP. The retaining may include retaining while a pressure within the tubular conduit is greater than a pressure within the subterranean formation, retaining while the pressure within the subterranean formation is greater than the pressure within the tubular conduit, and/or retaining during pressure cycling of the hydrocarbon well. These methods also include seating the sealing device on a sealing device seat of the selected SSP and repeating at least a portion of the methods to stimulate a plurality of subsequent regions of the subterranean formation.

The methods also may include methods of conveying a downhole tool within the hydrocarbon well utilizing the SSPs. These methods include restricting fluid flow through each SSP in a plurality of SSPs, with the plurality of SSPs being spaced-apart along a length of a wellbore tubular, with a respective sealing device by receiving the respective sealing device within a respective sealing device receptacle and on a respective sealing device seat of each SSP. These methods also include retaining the respective sealing device within the respective sealing device receptacle with a respective sealing device retainer of each SSP and establishing fluid communication between the subterranean formation and a downhole region of the tubular conduit. These methods further include positioning a downhole tool within an uphole region of the tubular conduit, providing a conveyance fluid to the tubular conduit, and pumping the downhole tool in a downhole direction within the tubular conduit.

DETAILED DESCRIPTION AND BEST MODE OF THE DISCLOSURE

Figure 1:
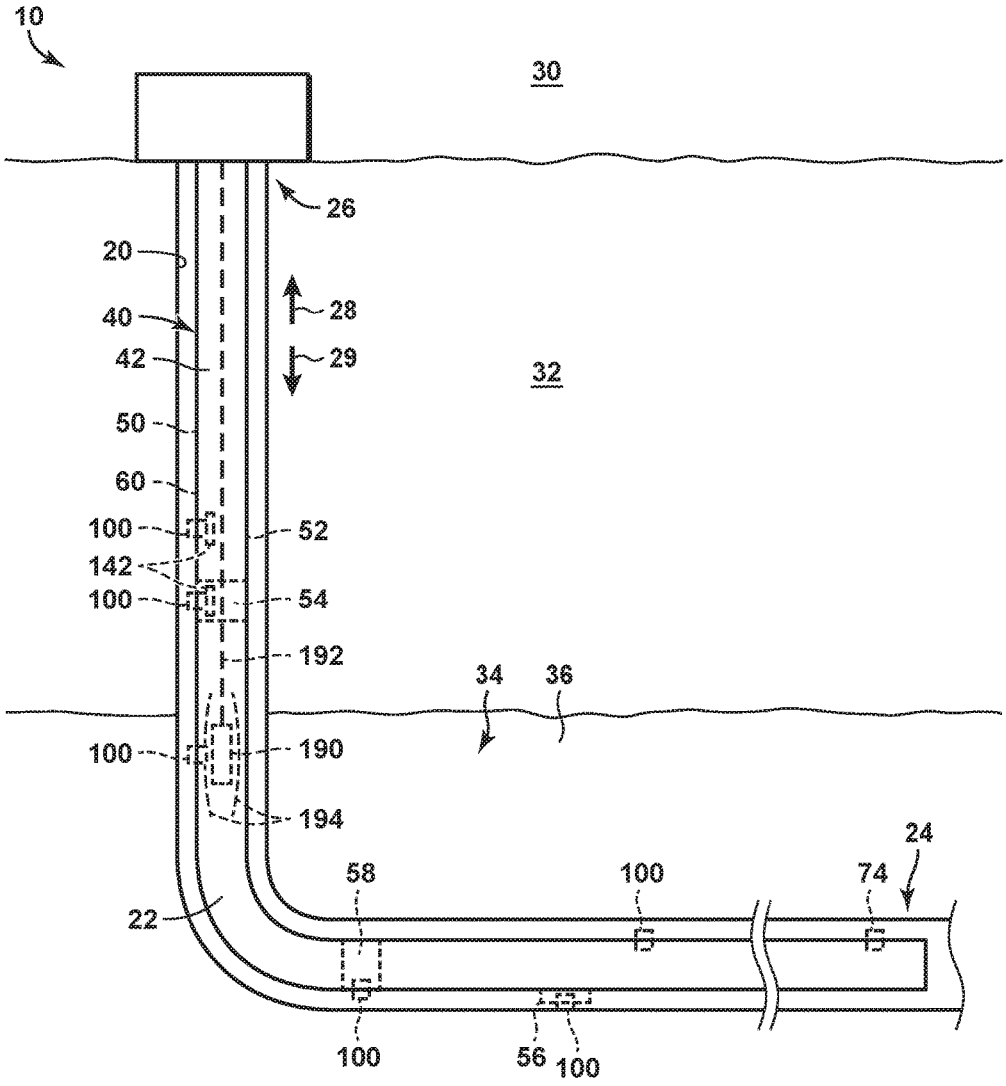
FIG. 1 is a schematic representation of examples of a hydrocarbon well that may include and/or utilize selective stimulation ports, wellbore tubulars, and/or methods, according to the present disclosure.

FIGS. 1-7 provide examples of hydrocarbon wells 10, of wellbore tubulars 40, of selective stimulation ports 100, of methods 1100, and/or of methods 1200, according to the present disclosure. Elements that serve a similar, or at least substantially similar, purpose are labeled with like numbers in each of FIGS. 1-7, and these elements may not be discussed in detail herein with reference to each of FIGS. 1-7. Similarly, all elements may not be labeled in each of FIGS. 1-7, but reference numerals associated therewith may be utilized herein for consistency. Elements, components, and/or features that are discussed herein with reference to one or more of FIGS. 1-7 may be included in and/or utilized with any of FIGS. 1-7 without departing from the scope of the present disclosure. In general, elements that are likely to be included in a particular embodiment are illustrated in solid lines, while elements that are optional are illustrated in dashed lines. However, elements that are shown in solid lines may not be essential and, in some embodiments, may be omitted without departing from the scope of the present disclosure.

FIG. 1 is a schematic representation of examples of a hydrocarbon well 10 that may include and/or utilize selective stimulation ports 100, wellbore tubulars 40, and/or methods 1100 and/or 1200, according to the present disclosure. Hydrocarbon wells 10 include wellbore tubular 40, which defines a tubular conduit 42. Hydrocarbon wells 10 also include a wellbore 20, which extends within a subterranean formation 34, and wellbore tubular 40 extends within the wellbore. Wellbore 20 also may be referred to herein as extending within a subsurface region 32 that includes subterranean formation 34 and/or as extending between a surface region 30 and subterranean formation 34. Subterranean formation 34 may include a reservoir fluid 36, such as a hydrocarbon, and hydrocarbon well 10 may be utilized to produce the reservoir fluid from the subterranean formation.

Hydrocarbon wells 10 also include a plurality of selective stimulation ports (SSPs) 100. As discussed in more detail herein with reference to FIGS. 2-5, each SSP 100 is operatively attached to wellbore tubular 40 such that a corresponding conduit-facing region 112 of the SSP faces toward tubular conduit 42 and also such that a corresponding formation-facing region 114 of the SSP faces away from tubular conduit 42, toward subsurface region 32, and/or toward subterranean formation 34.

As illustrated in FIG. 1, SSPs 100 may be spaced-apart from one another, such as along a length, or longitudinal length, of wellbore 20 and/or of wellbore tubular 40. Wellbore 20 and/or wellbore tubular 40 may include, have, and/or define an uphole end, or region, 26 and a downhole end, or region, 24. Downhole end 24 may be defined within subsurface region 32, may be defined within subterranean formation 34, and/or may be distal surface region 30 relative to uphole end 26. Uphole end 26 may open to surface region 30 and/or may be proximal surface region 30 relative to downhole end 24. Wellbore 20 further may define an uphole direction 28 and a downhole direction 29. Uphole direction 28 may be defined along a length of wellbore 20 and/or may point toward surface region 30. Conversely, downhole direction 29 may be defined along the length of wellbore 20 but may point toward downhole end 24.

As illustrated in dashed lines in FIG. 1, hydrocarbon well 10 may include a shockwave generation device 190, which may be positioned within tubular conduit 42. As illustrated in FIGS. 2-5, SSPs 100 may include an isolation device 120, and shockwave generation device 190, when present, may be configured to generate a shockwave 194 within a wellbore fluid 22 that extends within tubular conduit 42. Shockwave 194 may be utilized to transition isolation device 120 of a corresponding SSP 100 from a closed state to an open state. When in the closed state, the corresponding SSP may resist, block, and/or occlude fluid flow therethrough and/or between tubular conduit 42 and subterranean formation 34. When in the open state, the corresponding SSP may permit fluid flow therethrough and/or between the tubular conduit and the subterranean formation. Shockwave generation device 190 may be operatively attached to an umbilical 192, which may extend within tubular conduit 42 and/or may interconnect shockwave generation device 190 with surface region 30. Additional examples of shockwave generation devices 190, of components of SSPs 100, and/or of methods of operating SSPs 100 that may be included in and/or utilized with hydrocarbon wells 10, wellbore tubulars 40, SSPs 100, and/or methods 1100 and/or 1200, according to the present disclosure, are disclosed in U.S. Provisional Patent Application Nos. 62/262,034 and 62/262,036, which were filed on Dec. 2, 2015, and U.S. Provisional Patent Application No. 62/263,069, which was filed on Dec. 4, 2015, and the complete disclosures of which are hereby incorporated by reference.

Wellbore tubular 40 may include and/or be any suitable elongate tubular structure that may extend within wellbore 20 and/or that may define tubular conduit 42. As an example, wellbore tubular 40 may include and/or be a casing string 50. As another example, wellbore tubular 40 may include and/or be inter-casing tubing 60.

When wellbore tubular 40 includes casing string 50, SSPs 100 may be operatively attached to any suitable portion, or region, of casing string 50. As examples, one or more SSPs 100 may be operatively attached to one or more of a casing collar 54 of the casing string, a casing segment 52 of the casing string, a blade centralizer 56 of the casing string, and/or a sleeve 58 that slides over the casing string.

It is within the scope of the present disclosure that SSPs 100 may be operatively attached to wellbore tubular 40 prior to wellbore tubular 40 being positioned within wellbore 20. In addition, it is also within the scope of the present disclosure that SSPs 100 may be operatively attached to wellbore tubular 40 in any suitable manner. As examples, one or more SSPs 100 may be operatively attached to wellbore tubular 40 via one or more of a threaded connection, a glued connection, a press-fit connection, a welded connection, and/or a brazed connection. As additional examples, one or more SSPs 100 may be formed within wellbore tubular 40 and/or may be formed within a given segment, region, and/or portion of the wellbore tubular.

FIGS. 2-5 provide additional and/or more detailed examples of SSPs 100 according to the present disclosure. SSPs 100 of FIGS. 2-5 may include and/or be more detailed representations, or illustrations, of SSPs 100 of FIG. 1, and any of the structures, functions, and/or features that are discussed herein with reference to SSPs 100 of FIGS. 2-5 may be included in and/or utilized with hydrocarbon wells 10 of FIG. 1 without departing from the scope of the present disclosure. Similarly, any of the structures, functions, and/or features that are discussed herein with reference to hydrocarbon wells 10 of FIG. 1 may be utilized with SSPs 100 of FIGS. 2-5 without departing from the scope of the present disclosure.

Figure 2:
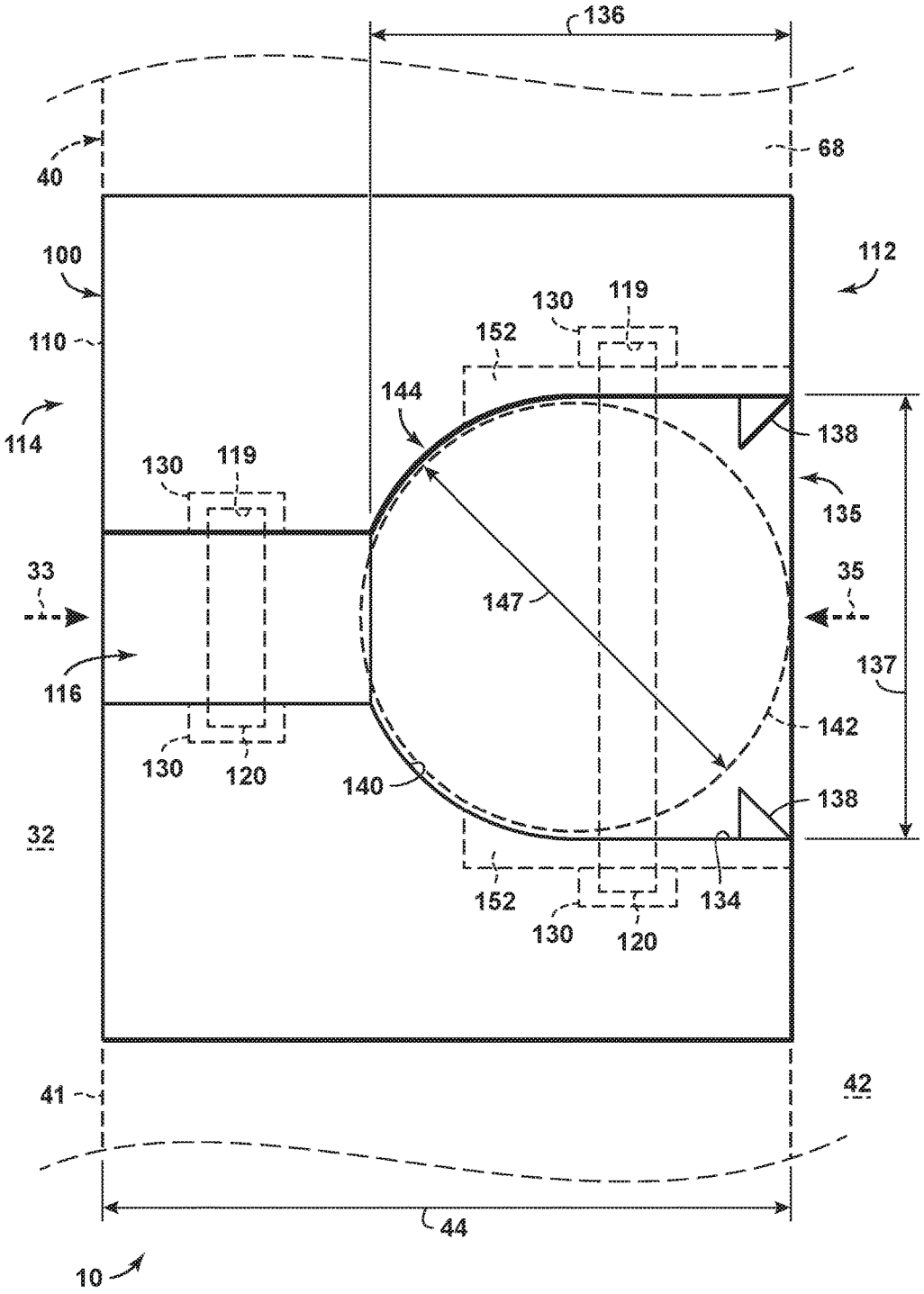
FIG. 2 is a schematic representation of examples of a selective stimulation port, according to the present disclosure, illustrating a seated sealing device.
Figure 3:
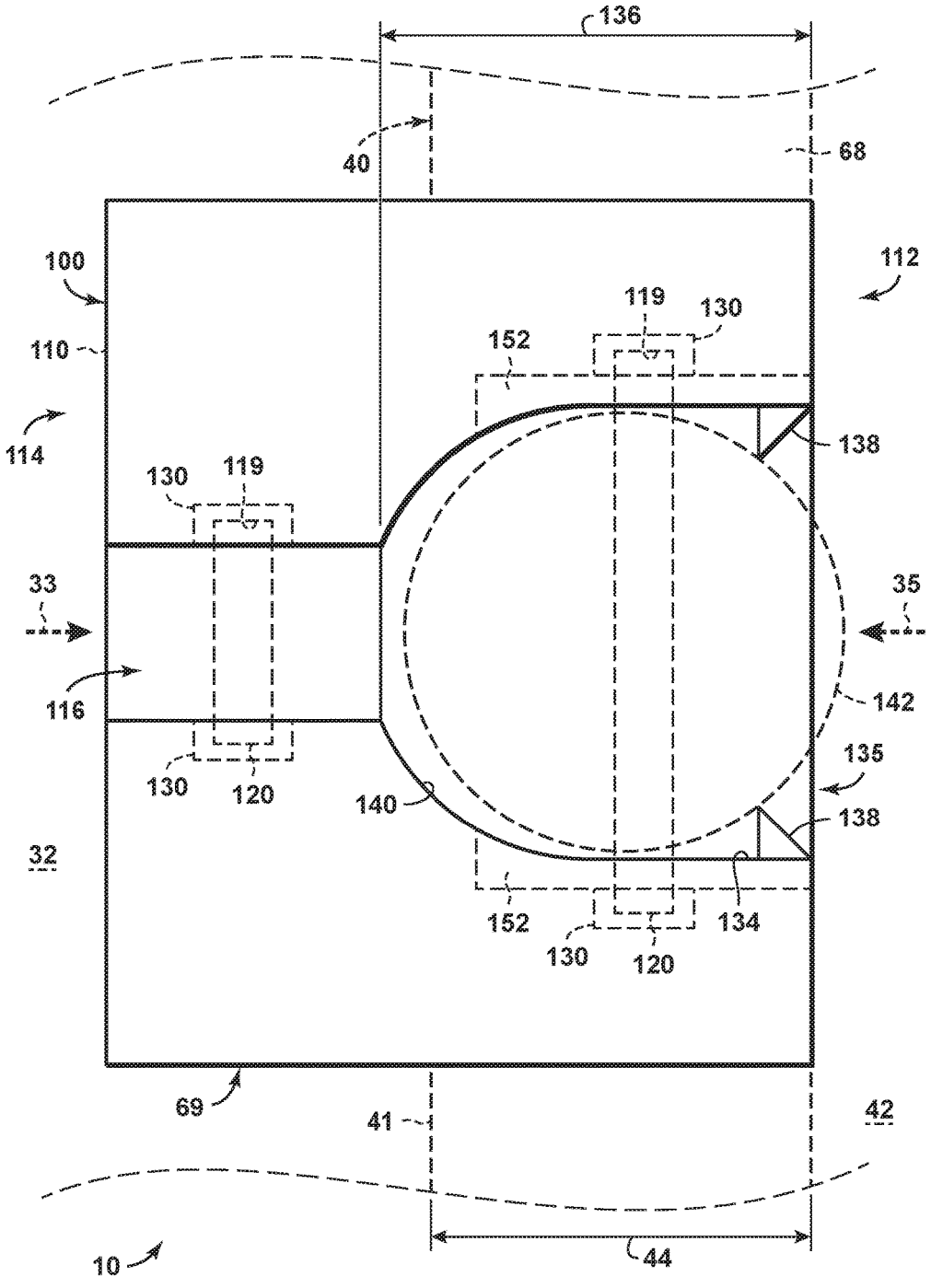
FIG. 3 is another schematic representation of the selective stimulation port of FIG. 2 illustrating an unseated sealing device.
Figure 4:
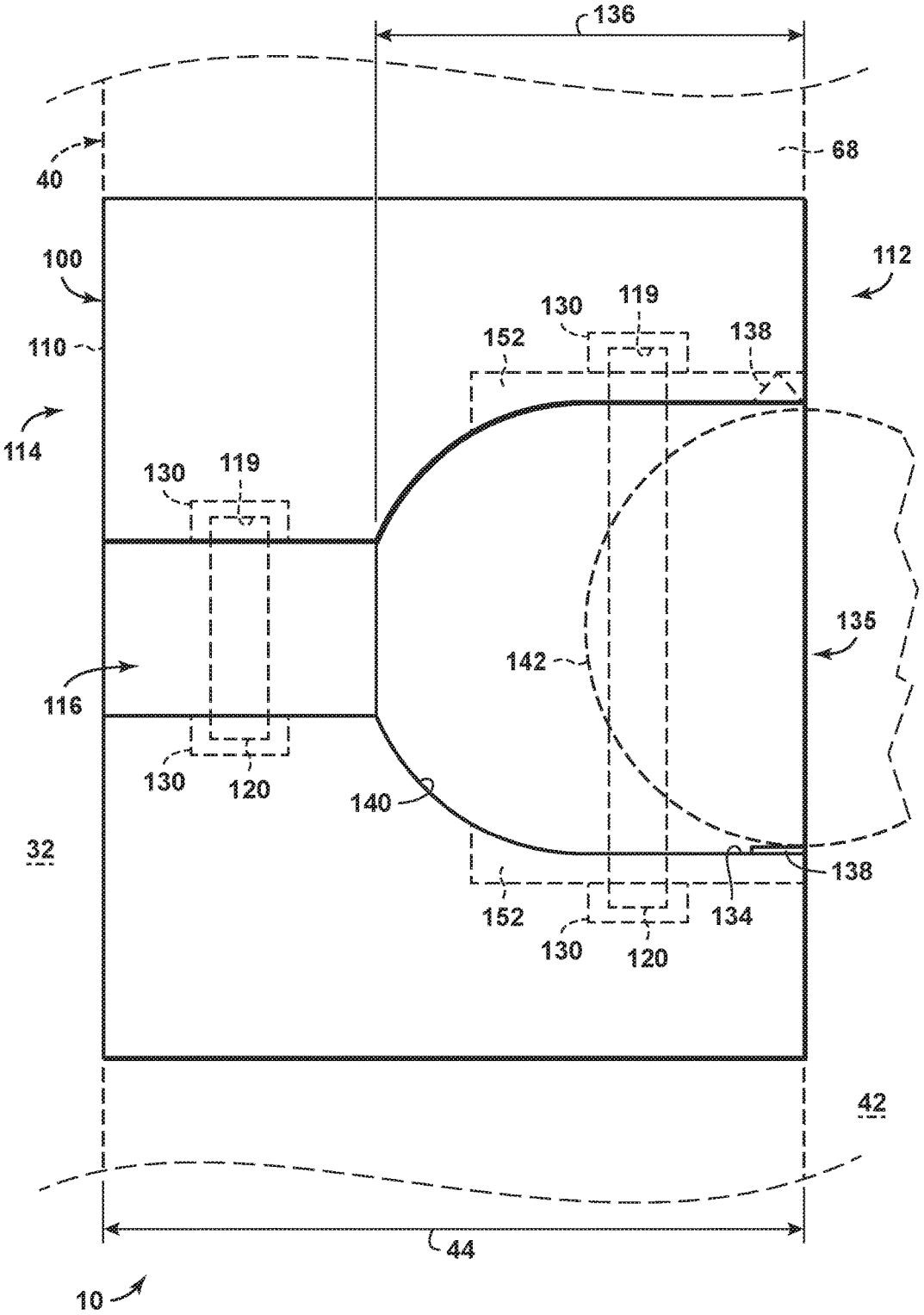
FIG. 4 is another schematic representation of the selective stimulation port of FIG. 2 illustrating a sealing device entering a sealing device receptacle.
Figure 5:
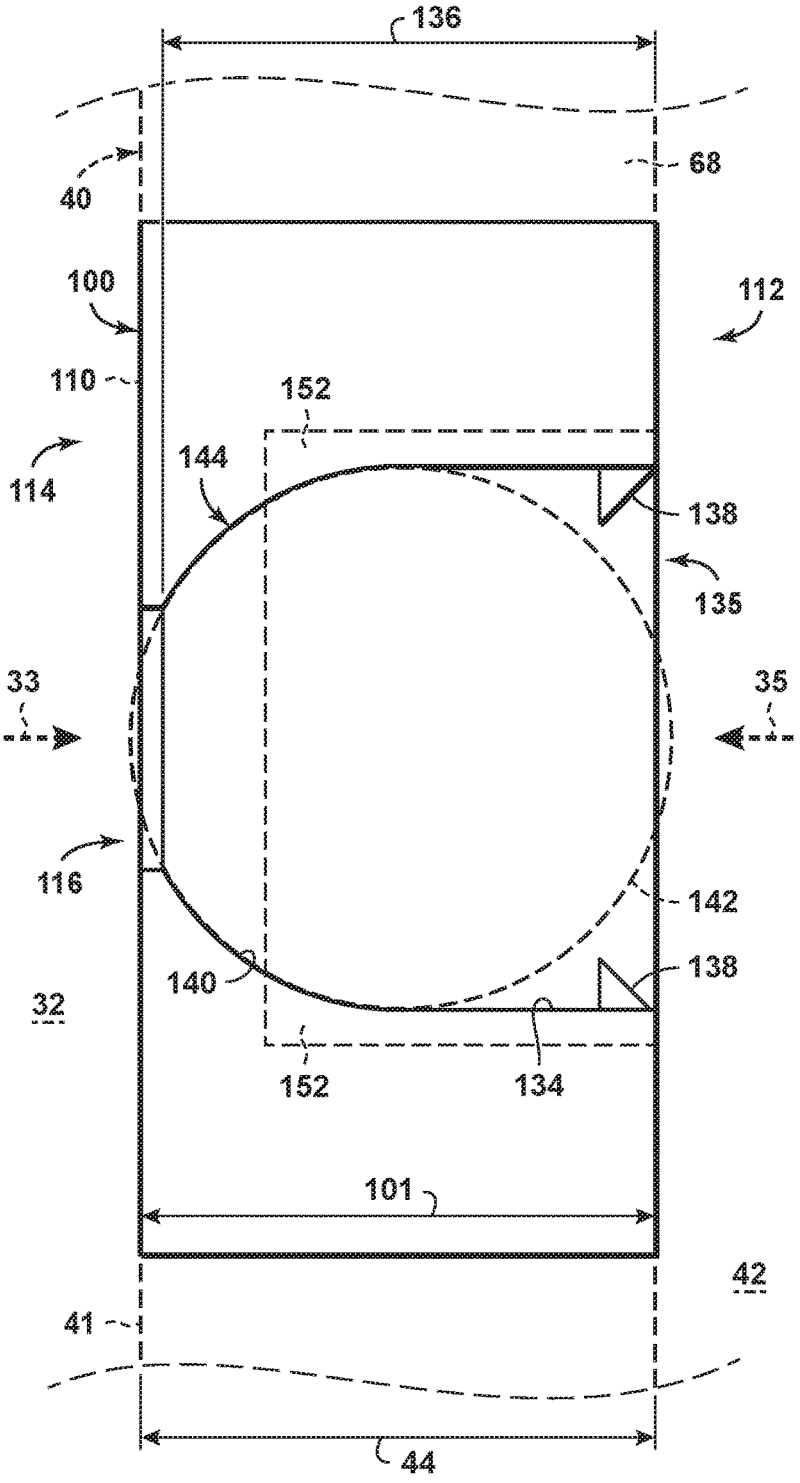
FIG. 5 is a schematic representation of examples of a selective stimulation port according to the present disclosure.

FIG. 2 is a schematic representation of examples of an SSP 100, according to the present disclosure, illustrating a seated sealing device 142, while FIG. 3 is another schematic representation of SSP 100 of FIG. 2 illustrating an unseated sealing device 142 that is retained within sealing device receptacle 134 by sealing device retainer 138. FIG. 4 is another schematic representation of SSP 100 of FIG. 2 illustrating sealing device 142 entering a sealing device receptacle 134 thereof, while FIG. 5 is a schematic representation of additional examples of a selective stimulation port 100 according to the present disclosure.

As illustrated in FIGS. 2-5, SSPs 100 are configured to be operatively attached to wellbore tubular 40 and define conduit-facing region 112 and formation-facing region 114. SSPs 100 include an SSP conduit 116 that extends perpendicular, or at least substantially perpendicular, to a wall 68 of wellbore tubular 40 and between conduit-facing region 112 and formation-facing region 114.

SSPs 100 also include a sealing device receptacle 134, which is sized to receive a sealing device 142 and defines at least a portion of SSP conduit 116. As perhaps best illustrated in FIG. 4, sealing device 142 may flow into sealing device receptacle 134 via tubular conduit 42. SSPs 100 further include a sealing device seat 140. Sealing device seat 140 defines at least a portion of SSP conduit 116 and is defined within and/or by sealing device receptacle 134. In addition, sealing device seat 140 is shaped to form a fluid seal 144, as illustrated in FIGS. 2 and 5, with sealing device 142.

SSPs 100 further include a sealing device retainer 138. Sealing device retainer 138 may be configured to permit sealing device 142 to enter and/or to be received within sealing device receptacle 134, such as to seat upon sealing device seat 140 to form a fluid seal therewith. Subsequent to the sealing device being received within the sealing device receptacle, sealing device retainer 138 is configured to retain the sealing device within the sealing device receptacle and also to permit the sealing device to be unseated from sealing device seat 140 while remaining within the sealing device receptacle, as illustrated in FIG. 3.

When sealing device 142 forms fluid seal 144 with sealing device seat 140, as illustrated in FIGS. 2 and 5, the sealing device selectively restricts a fluid outflow 35 from tubular conduit 42 and into subsurface region 32 via SSP conduit 116. Stated another way, fluid seal 144, when present, blocks, restricts, and/or occludes fluid flow through the SSP conduit. Conversely, when sealing device 142 does not form the fluid seal with sealing device seat 140, when sealing device 142 contacts sealing device retainer 138, and/or when sealing device 142 is unseated from sealing device seat 140, SSP 100 permits a fluid inflow 33 from subsurface region 32 into tubular conduit 42 via SSP conduit 116, as illustrated in FIG. 3. Under these conditions, sealing device retainer 138 may be referred to herein as retaining sealing device 142 within sealing device receptacle 134. SSPs 100 that include sealing devices 142 received within sealing device receptacles 134 automatically may form fluid seal 144 when a pressure within tubular conduit 42 is greater than a pressure within subsurface region 32, thus restricting fluid outflow 35. In addition, SSPs 100 automatically may permit fluid inflow 33 when the pressure within tubular conduit 42 is less than the pressure within subsurface region 32. Thus, and as discussed, the combination of a given sealing device 142 with a given SSP 100 may permit repeated seating of sealing device 142 on sealing device seat 140 and unseating of sealing device 142 from sealing device seat 140, which may cause sealing and unsealing of SSP conduit 116, respectively, during pressure cycling of the hydrocarbon well.

Referring generally to FIGS. 1-5, and during operation of hydrocarbon wells 10, tubular conduit 42 may be pressurized with a stimulant fluid and a selected SSP 100 then may be transitioned from the closed state to the open state. A volume of stimulant fluid then may be flowed into subterranean formation 34, such as to stimulate the subterranean formation. Subsequently, a sealing device 142 may be released within tubular conduit 42 and may be received by sealing device receptacle 134 of a corresponding SSP 100 and seated upon sealing device seat 140 thereof. The sealing device then is retained within sealing device receptacle 134 by sealing device retainer 138 of the SSP and permits fluid flow from the subterranean formation into the tubular conduit while restricting fluid flow from the tubular conduit into the subterranean formation. The combination of the SSP and the sealing device may be cycled between a configuration in which the sealing device restricts fluid flow and a configuration in which the sealing device permits fluid flow any suitable number of times. This cycling may be based solely upon a pressure differential between the tubular conduit and the subterranean formation and across the SSP and also may be referred to herein as pressure cycling the hydrocarbon well. Thus, the sealing device may be selectively and repeatedly seated on and unseated from the sealing device seat, with the sealing device retainer preventing the sealing device from being dissociated from the corresponding sealing device receptacle.

Sealing device retainer 138 may include and/or be any suitable structure that may be adapted, configured, designed, sized, shaped, and/or constructed to permit sealing device 142 to enter, or to be received within, sealing device receptacle 134 and/or to retain the sealing device within the sealing device receptacle. As an example, and as illustrated in FIGS. 2-5, sealing device receptacle 134 may include and/or define an aperture 135 within conduit-facing region 112 and sealing device retainer 138 may extend and/or project at least partially across the aperture.

As another example, sealing device retainer 138 may be biased, or may include a biasing structure, to permit motion of the sealing device into the sealing device receptacle and also to resist motion of the sealing device out of the sealing device receptacle. Stated another way, the sealing device retainer may be configured to permit the sealing device to flow, from the tubular conduit and past the sealing device retainer, into engagement, or sealing engagement, with the sealing device seat. However, the sealing device retainer may be configured to resist flow of the sealing device from and/or out of the sealing receptacle and to and/or into the tubular conduit.

Such biasing may be accomplished in any suitable manner. As an example, and as illustrated in solid lines in FIG. 4, sealing device retainer 138 may be configured to be compressed and/or deformed to permit the sealing device to enter the sealing device receptacle. As another example, and as illustrated in dashed lines in FIG. 4, sealing device retainer 138 may be configured to rotate and/or pivot to permit the sealing device to enter the sealing device receptacle. However, and subsequent to the sealing device entering the sealing device receptacle, sealing device retainer 138 may return to a configuration in which the sealing device retainer restricts movement of the sealing device from and/or out of the sealing device receptacle, as illustrated in FIGS. 2-3 and 5.

As discussed, SSP 100 and/or sealing device retainer 138 thereof may be configured to permit sealing device 142 to be unseated from sealing device seat 140 and to be reseated with the sealing device seat a plurality of times. As an example, sealing device retainer 138 may retain the sealing device within the sealing device receptacle while the sealing device is repeatedly seated on, and unseated from, the sealing device seat. Thus, SSPs 100 that include sealing devices 142 received within sealing device receptacles 134 may be configured to repeatedly permit fluid inflow 33 and/or to repeatedly restrict fluid outflow 35 during construction, completion, and/or operation of a hydrocarbon well 10 that includes the SSPs.

It is within the scope of the present disclosure that sealing device retainer 138 may include and/or be a permanent, or at least substantially permanent, sealing device retainer configured to retain a respective sealing device indefinitely. This may include retaining the respective sealing device over an operational lifetime of hydrocarbon well 10 and/or while the sealing device is seated upon, and unseated from, the sealing device seat any suitable number of times.

Conversely, it is also within the scope of the present disclosure that sealing device retainer 138 may be configured to temporarily retain the respective sealing device, such as to retain the respective sealing device for a predetermined, or desired, retention time and then to release the respective sealing device or otherwise permit the sealing device to flow out of the sealing device receptacle. Such a configuration may permit SSP 100 to selectively permit the fluid inflow and restrict the fluid outflow during the retention time and subsequently to permit increased and/or two-way fluid flow through SSP 100 subsequent to the removal of the respective sealing device from the sealing device receptacle.

The retention time may include and/or be any suitable time, timeframe, and/or time period. As an example, the retention time may be a fixed, predetermined, pre-established, and/or desired length of time. As more specific examples, the retention time may be at least 1 hour, at least 6 hours, at least 12 hours, at least 1 day, at least 5 days, at least 10 days, at least 20 days, and/or at least 30 days. Additionally or alternatively, the retention time may be at most 180 days, at most 150 days, at most 120 days, at most 90 days, at most 60 days, at most 30 days, at most 20 days, at most 10 days, at most 5 days, and/or at most 1 day.

With the above in mind, sealing device retainer 138 may include and/or be formed from any suitable material and/or materials. As examples, sealing device retainer 138 may include and/or be formed from a soluble material configured to dissolve within the wellbore fluid and/or a corrodible material configured to corrode within the wellbore fluid. Such a material may degrade, dissolve, and/or corrode to permit release of the sealing device after the retention time has elapsed. As additional examples, sealing device retainer 138 may include and/or be formed from an insoluble material, a non-corrodible material, and/or an inert material that does not degrade upon contact with the wellbore fluid. Such a material may permit the sealing device retainer to retain the respective sealing device indefinitely and/or to retain a plurality of different sealing devices, as discussed in more detail herein.

As illustrated in dashed lines in FIGS. 2-5, SSPs 100 may include one or more channels 152. Channels 152, when present, may be adapted, configured, sized, and/or shaped to permit and/or facilitate fluid inflow 33 to flow past sealing device 142 and/or sealing device retainer 138 when sealing device 142 is received within sealing device receptacle 134. As examples, channels 152 may decrease a resistance to the fluid inflow and/or may increase a cross-sectional area for flow of the fluid inflow.

Channels 152 may include any suitable structure. As examples, channels 152 may include and/or be one or more of grooves, recesses, and/or flutes. In addition, channels 152 may be defined by and/or within any suitable portion of SSP 100. As an example, channels 152 may be defined by sealing device retainer 138. As another example, channels 152 may be defined by an SSP body 110. SSP body 110, when present, also may define one or more of SSP conduit 116, sealing device receptacle 134, sealing device seat 140, and/or sealing device retainer 138.

Sealing device receptacle 134 may have and/or define any suitable shape. As an example, the shape of the sealing device receptacle may correspond to a shape of a corresponding sealing device 142 that is to be received by, or is received within, the sealing device receptacle. As another example, the sealing device receptacle may be a cylindrical, or at least partially cylindrical, sealing device receptacle. As yet another example, sealing device 142 may define a sealing device diameter 147 and sealing device receptacle 134 may define a receptacle diameter 137 that is greater than the sealing device diameter. This is illustrated in FIG. 2.

It is within the scope of the present disclosure that sealing device receptacle 134 may be shaped and/or sized to contain and/or house an entirety of sealing device 142, at least when the sealing device forms fluid seal 144 with sealing device seat 140. Stated another way, sealing device 142 may be contained entirely within sealing device receptacle 134 when it is seated on and unseated from the sealing device seat. Under these conditions, sealing device receptacle 134 may be referred to herein as having a receptacle depth 136 that is greater than the sealing device diameter. Such a configuration may permit operation of SSP 100 without sealing device 142 projecting into subsurface region 32 and/or into tubular conduit 42 and also is illustrated in FIG. 2.

Alternatively, it is also within the scope of the present disclosure that a portion (typically a minority portion) of sealing device 142 may project from sealing device receptacle 134 and into tubular conduit 42 and/or into subsurface region 32, as illustrated in FIG. 5 when the sealing device is seated upon and/or unseated from the sealing device seat. Such a configuration may permit SSP 100 to be narrower and/or may permit a width 101 of SSP 100 to correspond to a wellbore tubular thickness 44 of wellbore tubular 40.

Sealing device seat 140 may include any suitable structure that defines at least a portion of SSP conduit 116, is defined within sealing device receptacle 134, and/or is shaped to form the fluid seal with sealing device 142. As an example, and as discussed, sealing device seat 140 may be formed and/or defined by SSP body 110. As another example, a shape of sealing device seat 140 may correspond to, or complement, a shape of sealing device 142. As yet another example, sealing device seat 140 may have a seat radius of curvature that is at least substantially similar to, and optionally the same as, a sealing device radius of curvature of sealing device 142. As another example, sealing device seat 140 may be a pre-formed and/or premanufactured sealing device seat that may have a preconfigured geometry, or shape, that is established prior to SSP 100 being operatively attached to tubular conduit 42 and/or prior to tubular conduit 42 being installed within subterranean formation 34.

It is within the scope of the present disclosure that sealing device seat 140 may be configured to resist damage and/or deterioration upon exposure to environmental conditions present within hydrocarbon well 10. As an example, sealing device seat 140 may include and/or be an erosion-resistant sealing device seat that is configured to resist erosion by particulate matter that may be present within a wellbore fluid when the wellbore fluid flows through and/or past the sealing device seat. As another example, sealing device seat 140 may include and/or be a corrosion-resistant sealing device seat configured to resist corrosion by the wellbore fluid when the wellbore fluid contacts the sealing device seat.

As discussed, SSPs 100 may be operatively attached to wellbore tubular 40, and SSPs 100 may define any suitable spatial relationship, orientation, relative size, and/or geometry relative to wellbore tubular 40. As an example, wellbore tubular 40 may have and/or define wall thickness 44, and sealing device receptacle 134 may define a receptacle depth 136 that is greater than, equal to, or less than, wall thickness 44.

When receptacle depth 136 is greater than wall thickness 44, and as illustrated in FIG. 3, wellbore tubular 40, SSP 100, and/or SSP body 110 thereof may include a projecting region 69 that projects from an external surface 41 of wellbore tubular 40. Under these conditions, SSP 100 may be positioned within, or may define, projecting region 69. An example of projecting region 69 includes a centralizer wing for wellbore tubular 40.

It is within the scope of the present disclosure that SSPs 100 may be operatively attached to wellbore tubular 40 in any suitable manner and/or that SSPs 100 may be operatively attached to any suitable portion of wellbore tubular 40. As examples, SSPs 100 may be at least partially defined by the wellbore tubular, at least partially formed within the wellbore tubular, at least partially defined by a tubular collar of the wellbore tubular, at least partially formed within the tubular collar, at least partially defined by a tubular segment of the wellbore tubular, and/or at least partially formed within the tubular segment.

Sealing device 142 may include and/or be any suitable structure and/or structures that is/are sized and/or configured to be received within sealing device receptacle 134, to form fluid seal 144 with sealing device seat 140, and to be retained by sealing device retainer 138. As an example, sealing device 142 may include any known ball sealer or perforation sealer. A conventional ball sealer has a generally spherical shape and may include an abrasion-resistant and/or cut-resistant outer layer. Another example of a suitable sealing device is a PERF PODS™ sealing device that is available from Thru Tubing Solutions, Inc. of Oklahoma City, Okla. A PERF PODS™ sealing device includes a primary sealing core from which a plurality of secondary tendrils extends to form secondary seals, such as of one or more leakage pathways between the primary sealing core and the sealing device seat.

Similarly, sealing device 142 may be formed from any suitable material and/or materials. As examples, sealing device 142 may be formed from a soluble material configured to dissolve within the wellbore fluid and/or from a corrodible material configured to be corroded by the wellbore fluid. Such a configuration may permit the sealing device to be retained within the sealing device receptacle for the retention time and then to degrade such that the sealing device is released from the sealing device receptacle. Under these conditions, it is within the scope of the present disclosure that a second, or subsequent, sealing device later may be received within the sealing device receptacle.

As additional examples, sealing device 142 may be formed from an insoluble material and/or from a non-corrodible material that does not degrade upon contact with the wellbore fluid. Such a material may permit the sealing device to be retained within the sealing device receptacle indefinitely.

As illustrated in dashed lines in FIGS. 2-4 and discussed herein, SSPs 100 optionally may include an isolation device 120 and a retention device 130. Isolation device 120, when present, may extend within SSP conduit 116. In addition, isolation device 120 may be configured to selectively transition, or be transitioned, from a closed state, in which the isolation device restricts fluid flow through the SSP conduit, to an open state, in which the isolation device permits fluid flow through the SSP conduit. This transition may be, may occur, and/or may be initiated responsive to receipt of a shockwave, which has greater than a threshold shockwave intensity, by the isolation device. The shockwave may be generated by a shockwave generation device, such as shockwave generation device 190 of FIG. 1, within a wellbore fluid, such as wellbore fluid 22 of FIG. 1, that extends within tubular conduit 42. Retention device 130 may be configured to retain isolation device 120 in the closed state prior to receipt of the shockwave.

It is within the scope of the present disclosure that isolation device 120 may be configured to exhibit only a single transition from the closed state to the open state. As an example, at least a portion of the isolation device may be configured to separate from a remainder of the SSP upon transitioning from the closed state to the open state.

As a more specific example, at least a portion of the isolation device may be configured to break apart, or disintegrate, upon transitioning from the closed state to the open state. As an example, and prior to transitioning from the closed state to the open state, isolation device 120 may have and/or define a first maximum dimension. However, subsequent to transitioning from the closed state to the open state, the isolation device may define a second maximum dimension that is less than the first maximum dimension. As another example, and prior to transitioning from the closed state to the open state, isolation device 120 may include and/or be a single-piece isolation device. However, and upon transitioning to the open state, the isolation device may define a plurality of spaced-apart segments and/or pieces.

As yet another example, isolation device 120 may include an isolation disk that may be conveyed into the subterranean formation from a formation-facing end of SSP conduit 116 when the isolation device transitions from the closed state to the open state.

Isolation device 120 may include and/or be formed from any suitable material and/or materials. As examples, isolation device 120 may include one or more of a magnetic material, a radioactive material, an acid-soluble material, and a frangible material.

As also illustrated in dashed lines in FIGS. 2-4, SSP 100 further may include an isolation device recess 119. Isolation device recess 119 may be configured to receive, house, and/or contain at least a portion of isolation device 120 prior to the isolation device transitioning from the closed state to the open state.

It is within the scope of the present disclosure that isolation device 120 may be positioned within any suitable portion, or region, of SSP 100. As an example, isolation device 120 may be positioned between sealing device seat 140 and subsurface region 32. Such a configuration may prevent particulate matter, which may be present within the subsurface region, from contacting sealing device seat 140 and/or entering sealing device receptacle 134 at least prior to the isolation device being transitioned from the closed state to the open state. As another example, isolation device 120 may be positioned to separate, or to fluidly separate, sealing device seat 140 from tubular conduit 42. Such a configuration may protect the sealing device seat from materials that may be conveyed through the tubular conduit. As an example, such a configuration may protect the sealing device seat from abrasion by a proppant and/or from corrosion by an acid that may be conveyed into subsurface region 32 via the tubular conduit.

Figure 6:
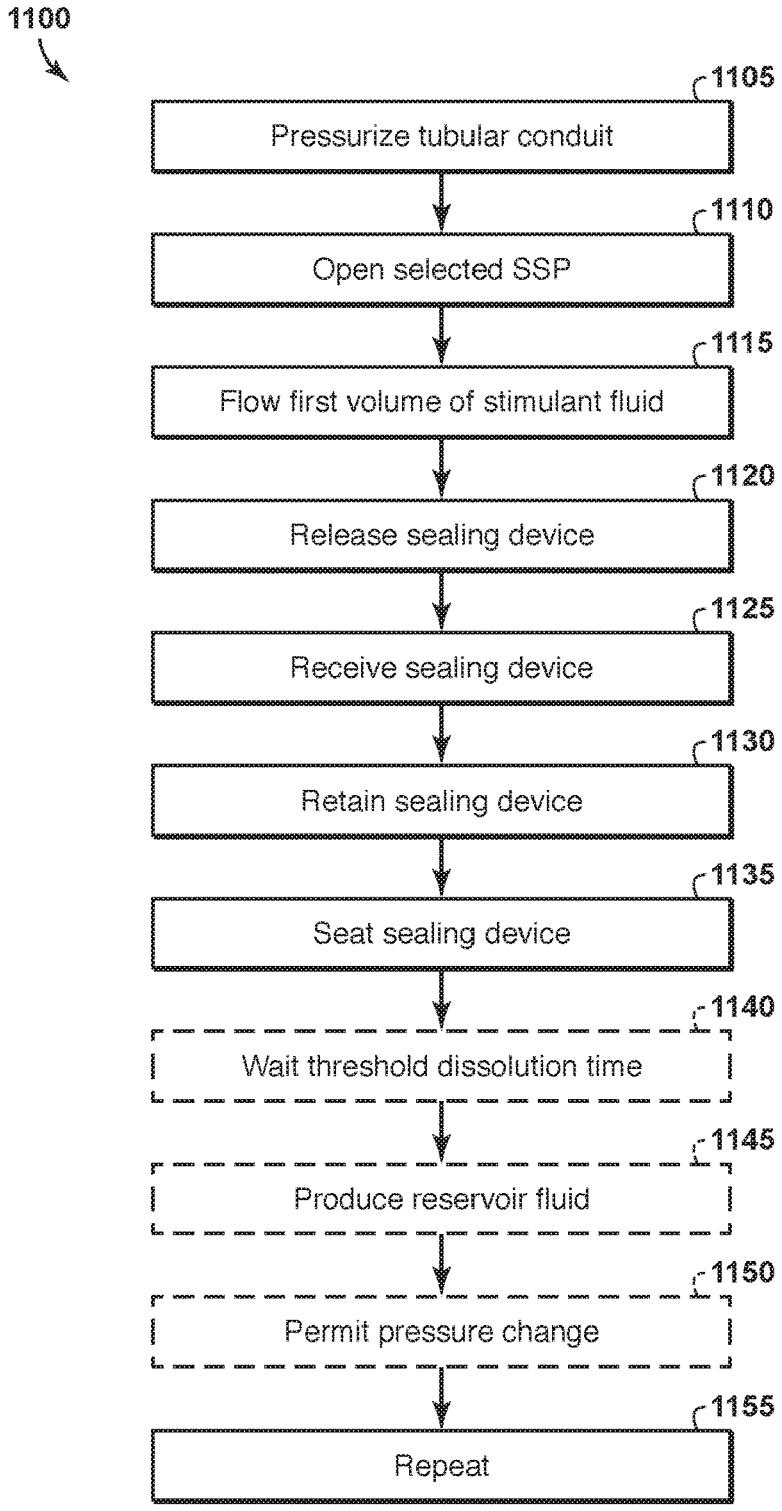
FIG. 6 is a flowchart depicting methods, according to the present disclosure, of stimulating a hydrocarbon well.

FIG. 6 is a flowchart depicting methods 1100, according to the present disclosure, of stimulating a hydrocarbon well. The hydrocarbon well includes a wellbore tubular that defines a tubular conduit and extends within a wellbore. The hydrocarbon well further includes a plurality of selective stimulation ports (SSPs) spaced-apart along a length of the wellbore tubular. Examples of the hydrocarbon well are illustrated in FIG. 1 and discussed in more detail herein with reference thereto.

Methods 1100 include pressurizing a tubular conduit at 1105, opening a selected SSP at 1110, flowing a first volume a stimulant fluid at 1115, and releasing a sealing device at 1120. Methods 1100 further include receiving the sealing device at 1125, retaining the sealing device at 1130, and seating the sealing device at 1135. Methods 1100 also may include waiting a threshold dissolution time at 1140, producing a reservoir fluid at 1145, and/or permitting a pressure change at 1150 and include repeating at least a portion of the methods at 1155.

Pressurizing the tubular conduit at 1105 may include pressurizing the tubular conduit with a stimulant fluid. The pressurizing at 1105 may be accomplished in any suitable manner. As examples, the pressurizing at 1105 may include providing the stimulant fluid to, or pumping the stimulant fluid into, the tubular conduit, such as from a surface region.

Opening the selected SSP at 1110 may include opening a selected SSP of the plurality of SSPs to permit fluid flow, or a fluid outflow, from the tubular conduit and into the subterranean formation. The fluid flow may be through and/or via an SSP conduit of the selected SSP. The opening at 1110 may be accomplished in any suitable manner. As an example, the opening at 1110 may include transitioning an isolation device of the selected SSP from a closed state to an open state. As a more specific example, the opening at 1110 may include generating, within the tubular conduit, a shockwave of greater than a threshold shockwave intensity to transition the isolation device from the closed state to the open state. Examples of the isolation device are discussed herein with reference to isolation device 120 of FIGS. 2-4.

Flowing the first volume of the stimulant fluid at 1115 may include flowing the first volume of stimulant fluid into the subterranean formation via the SSP conduit. This may include flowing to stimulate a first region of the subterranean formation and/or flowing responsive to, or as a result of, the pressurizing at 1105 and/or the opening at 1110.

Releasing the sealing device at 1120 may include releasing the sealing device in, within, and/or into the tubular conduit. The releasing at 1120 may be accomplished in any suitable manner. As an example, the releasing at 1120 may include positioning the sealing device within the tubular conduit. As additional examples, the releasing at 1120 may include releasing from the surface region and/or releasing from a sealing device source that is positioned within and/or forms a portion of the hydrocarbon well. Examples of the sealing device are disclosed herein with reference to sealing device 142 of FIGS. 1-5.

Receiving the sealing device at 1125 may include receiving the sealing device within a sealing device receptacle of the selected SSP. The receiving at 1125 may include flowing the sealing device along the tubular conduit and to the selected SSP, receiving the sealing device from the tubular conduit, and/or flowing the sealing device from the tubular conduit and into the selected SSP. Examples of the sealing device receptacle are disclosed herein with reference to sealing device receptacle 134 of FIGS. 2-5.

Retaining the sealing device at 1130 may include retaining the sealing device within the sealing device receptacle with a sealing device retainer of the selected SSP. It is within the scope of the present disclosure that the retaining at 1130 may include retaining the sealing device, within the sealing device receptacle, during a remainder of methods 1100 and/or during at least a portion of the repeating at 1155. As examples, the retaining at 1130 may include retaining during the seating at 1135, during the waiting at 1140, during the producing at 1145, during the permitting at 1150, and/or during the repeating at 1155. Examples of the sealing device retainer are disclosed herein with reference to sealing device retainer 138 of FIGS. 2-5.

Seating the sealing device at 1135 may include seating the sealing device on a sealing device seat of the selected SSP. This may include seating to form a fluid seal between the sealing device and the sealing device seat and/or seating to resist the fluid outflow of the stimulant fluid, which may flow from the tubular conduit and into the subterranean formation via the SSP conduit of the selected SSP. Examples of the sealing device seat are disclosed herein with reference to sealing device seat 140 of FIGS. 2-5.

Waiting the threshold dissolution time at 1140 may include waiting any suitable threshold dissolution time to permit the sealing device to dissolve and/or to corrode, such as to permit release of the sealing device from the sealing device receptacle of the respective SSP. It is within the scope of the present disclosure that the waiting at 1140 may be performed subsequent to at least a portion of the repeating at 1155. As an example, the waiting at 1140 may be performed subsequent to repeating the pressurizing at 1105, the opening at 1110, the flowing at 1115, the releasing at 1120, the receiving at 1125, the retaining at 1130, and the seating at 1135 a plurality of times, via the plurality of SSPs, to stimulate a plurality of spaced-apart, or different, regions of the subterranean formation and to seal the plurality of SSPs with a corresponding plurality of sealing devices. This may include pressure cycling the hydrocarbon well and/or repeatedly and sequentially seating the sealing device on the sealing device seat and subsequently unseating the sealing device from the sealing device seat. The waiting at 1140 may include waiting to permit and/or facilitate dissolution and/or corrosion of the corresponding plurality of sealing devices, to release the corresponding plurality of sealing devices from the plurality of SSPs, and/or to permit both fluid inflow and fluid outflow through the plurality of SSPs.

Producing the reservoir fluid at 1145 may include producing the reservoir fluid from the subterranean formation. This may include permitting the fluid inflow of the reservoir fluid into the tubular conduit via the SSP conduit of the respective SSP. Additionally or alternatively, the producing at 1145 also may include producing the reservoir fluid while retaining the sealing device within the sealing device receptacle with the sealing device retainer of the respective SSP. It is within the scope of the present disclosure that the producing at 1145 may be performed subsequent to at least a portion of the repeating at 1155, such as is discussed herein with reference to the waiting at 1140. Stated another way, the producing at 1145 may be performed subsequent to stimulating the plurality of regions of the subterranean formation and/or subsequent to retaining a respective sealing device within a respective sealing device seat of each of the plurality of SSPs with a corresponding sealing device retainer of each of the plurality of SSPs. Under these conditions, the producing at 1145 may include permitting the fluid inflow via a plurality of SSP conduits of the plurality of SSPs while retaining the respective sealing device within the respective sealing device receptacle of each of the plurality of SSPs. The retaining may permit and/or facilitate re-seating of the respective sealing device with the respective sealing device seat subsequent to the producing at 1145, during the permitting at 1150, and/or during the repeating at 1155.

Additionally or alternatively, the producing at 1145 also may be performed subsequent to the waiting at 1140. Under these conditions, the plurality of respective sealing devices may be released from, or not retained within the respective sealing device receptacle of, the plurality of SSPs during the producing at 1145.

Permitting the pressure change at 1150 may include permitting, or even facilitating, any suitable pressure change within the wellbore tubular and/or within the subterranean formation and may be performed subsequent to at least the portion of the repeating at 1155 that is discussed herein with reference to the waiting at 1140. The permitting at 1150 also may include unintended, inadvertent, and/or unexpected pressure changes, such as may be caused by failure of a pump that is utilized to pressurize the tubular conduit and/or failure of a sealing device that restricts fluid flow from the tubular conduit and into the subterranean formation. As an example, the permitting at 1150 may include permitting a pressure within the subterranean formation to exceed a pressure within the tubular conduit, such as to provide, or allow, a motive force for flow of a reservoir fluid into the tubular conduit via the SSP conduits of the plurality of SSPs. Under these conditions, the retaining at 1130 may include retaining during the permitting at 1150.

As another example, the permitting at 1150 may include permitting a pressure within a region of the tubular conduit that is associated with the selected SSP to decrease to a conduit pressure that is less than a formation pressure within a region of the subterranean formation that is associated with the selected SSP. Under these conditions, fluid may flow from the subterranean formation into the tubular conduit via the SSP conduit of the selected SSP, and the retaining at 1130 may include retaining during the permitting at 1150. When methods 1100 include the permitting at 1150, the repeating at 1155 may include re-seating the sealing devices on their respective sealing device seats to restrict fluid flow from the tubular conduit into the subterranean formation when the pressure within the tubular conduit is increased to a pressure that is greater than the pressure within the subterranean formation.

Repeating at least a portion of the methods at 1155 may include repeating any suitable portion of methods 1100 in any suitable order and/or in any suitable manner. As an example, and as discussed, the repeating at 1155 may include repeating the pressurizing at 1105, repeating the opening at 1110, repeating the flowing at 1115, repeating the releasing at 1120, repeating the receiving at 1125, repeating the retaining at 1130, and/or repeating the seating at 1135 a plurality of times to stimulate the plurality of regions of the subterranean formation. This portion of the repeating at 1155 also may be referred to herein as repeating to stimulate the subterranean formation and/or as stimulating the subterranean formation.

Subsequent to repeating to stimulate the subterranean formation, and as also discussed, the repeating at 1155 may include performing one or more additional, or optional, steps of methods 1100, such as by performing the waiting at 1140, the producing at 1145, and/or the permitting at 1150. Additionally or alternatively, and subsequent to performing the producing at 1145, the repeating at 1155 also may include repeating the pressurizing at 1105 to seat the plurality of sealing devices on the corresponding plurality of sealing device seats of the plurality of SSPs. Additionally or alternatively, the repeating at 1155 may include sequentially repeating the pressurizing at 1105 and the producing at 1145 a plurality of times while continuing the retaining at 1130. This process also may be referred to herein as pressure cycling the hydrocarbon well.

Returning to FIG. 1, and as illustrated in dashed lines, hydrocarbon well 10 may include a fluid port 74, which may be positioned at, proximate, and/or near downhole end 24. Fluid port 74, when present, may be configured to be selectively transitioned between an open state and a closed state. When in the open state, fluid port 74 may permit fluid flow between tubular conduit 42 and subterranean formation 34; and when in the closed state, fluid port 74 may resist, block, and/or occlude fluid flow between the tubular conduit and the subterranean formation.

In general, fluid port 74 is different and/or distinct from SSPs 100. As an example, fluid port 74 may include and/or be a toe sleeve. As another example, fluid port 74 may exclude, or may not include, a sealing device receptacle and/or a sealing device retainer. In contrast, and as discussed in more detail herein with reference to FIGS. 2-5, SSPs 100 include both a sealing device receptacle 134 and a sealing device retainer 138. However, this is not required to all embodiments, and it is also within the scope of the present disclosure that fluid port 74 may include, or be, an SSP 100.

Figure 7:
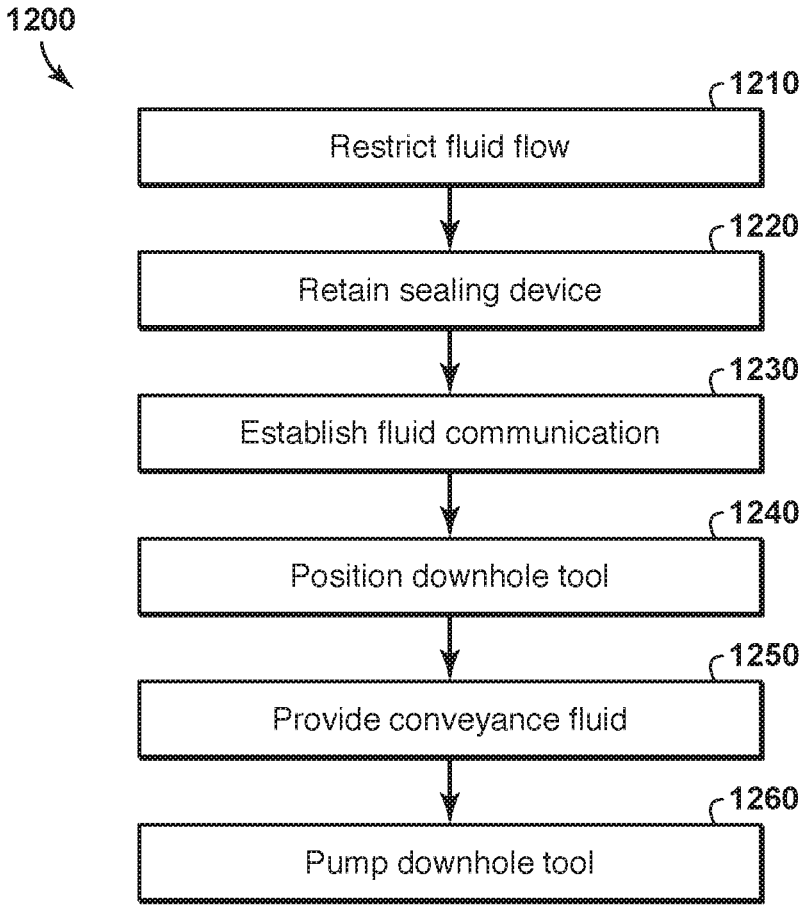
FIG. 7 is a flowchart depicting methods, according to the present disclosure, of conveying a downhole tool within a hydrocarbon well.

As discussed in more detail herein with respect to methods 1200 of FIG. 7, and during operation of hydrocarbon well 10, fluid port 74 may be utilized to facilitate conveyance of a downhole tool, such as shockwave generation device 190, within hydrocarbon well 10. As an example, and while fluid flow through SSPs 100 is blocked and/or occluded, such as by sealing device 142, fluid port 74 may be transitioned to the open state. Subsequently, a conveyance fluid may be provided to tubular conduit 42, such as from surface region 30, and the conveyance fluid may be utilized to pump the downhole tool in downhole direction 29. Under these conditions, flow of the conveyance fluid through fluid port 74 may permit and/or facilitate flow of the conveyance fluid into the tubular conduit and/or pumping of the downhole tool in the downhole direction.

With the above discussion in mind, FIG. 7 is a flowchart depicting methods 1200, according to the present disclosure, of conveying a downhole tool within a hydrocarbon well. The hydrocarbon well includes a wellbore tubular that defines a tubular conduit and extends within a wellbore. The hydrocarbon well also includes a plurality of SSPs spaced-apart along a length of the wellbore tubular. Examples of the hydrocarbon well are illustrated in FIG. 1 and discussed in more detail herein with reference thereto. Methods 1200 include restricting a fluid flow at 1210, retaining a sealing device at 1220, and establishing fluid communication at 1230. Methods 1200 further include positioning a downhole tool at 1240, providing a conveyance fluid at 1250, and pumping the downhole tool at 1260.

Restricting the fluid flow at 1210 may include restricting fluid flow through each SSP in the plurality of SSPs with a respective sealing device of a plurality of sealing devices. The restricting at 1210 may include receiving the respective sealing device within a respective sealing device receptacle and/or on a respective sealing device seat of each SSP. Examples of the sealing device receptacle are disclosed herein with reference to sealing device receptacles 134 of FIGS. 2-5. Examples of the sealing device seat are disclosed herein with reference to sealing device seat 140 of FIGS. 2-5.

Retaining the sealing device at 1220 may include retaining each respective sealing device within the respective sealing device receptacle with a respective sealing device retainer of each SSP. Examples of the sealing device retainer are disclosed herein with reference to sealing device retainers 138 of FIGS. 2-5.

Establishing fluid communication at 1230 may include establishing fluid communication between the subterranean formation and a downhole region, a downhole portion, and/or a toe-end of the tubular conduit. The establishing at 1230 may be accomplished in any suitable manner. As an example, the establishing at 1230 may include removing a selected sealing device from a downhole SSP of the plurality of SSPs that is present within the downhole region of the tubular conduit. This may include removing without removing the respective sealing device from a remainder of the plurality of SSPs. As an example, the selected sealing device may be soluble within the wellbore fluid, while a remainder of the sealing devices may not be soluble, or may not be as soluble, within the wellbore fluid. Under these conditions, the removing may include dissolving the selected sealing device within the wellbore fluid. As another example, a selected sealing device retainer of the downhole SSP may be soluble within the wellbore fluid, while a remainder of the sealing device retainers may not be soluble, or may not be as soluble, within the wellbore fluid. Under these conditions, the removing may include dissolving the selected sealing device retainer within the wellbore fluid.

As another example, the establishing at 1230 may include opening a fluid port that is present within the downhole region of the tubular conduit. This may include opening the fluid port without removing the respective sealing devices from the plurality of SSPs and may be accomplished in any suitable manner. As an example, the opening may include dissolving a selected sealing device, which seals the fluid port, within the wellbore fluid. As another example, the opening may include utilizing a pressure differential to unseat the selected sealing device from the fluid port. As yet another example, the opening may include transitioning the fluid port from a closed state to an open state. Examples of the fluid port are disclosed herein with reference to fluid port 74 of FIG. 1.

Positioning the downhole tool at 1240 may include positioning any suitable downhole tool within an uphole region, or portion, of the tubular conduit. An example of the downhole tool includes a shockwave generation device, such as shockwave generation device 190 of FIG. 1. Additional examples of the downhole tool are disclosed herein.

Providing the conveyance fluid at 1250 may include providing any suitable conveyance fluid to the tubular conduit. This may include pumping the conveyance fluid into the tubular conduit, such as from a surface region, and may be at least substantially similar to the pressurizing at 1105, which is discussed herein with reference to methods 1100 of FIG. 6.

Pumping the downhole tool at 1260 may include pumping the downhole tool in a downhole direction via flow of the conveyance fluid within the tubular conduit. Stated another way, the pumping at 1260 may include providing a motive force for motion of the downhole tool, within the tubular conduit, via the providing at 1250 and/or via flow of the conveyance fluid through the tubular conduit and into the subterranean formation. Flow of the conveyance fluid into the subterranean formation may be facilitated by the establishing at 1230.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The selective stimulation ports, wellbore tubulars, hydrocarbon wells, and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What we claim is:

1. A selective stimulation port (SSP) having a conduit-facing region and a formation-facing region and configured to be operatively attached to a wellbore tubular that defines a tubular conduit, wherein the wellbore tubular is configured to extend within a wellbore that extends within a subterranean formation, the SSP comprising:

an SSP conduit that extends at least substantially perpendicular to a wall of the wellbore tubular and between the conduit-facing region and the formation-facing region;

a sealing device receptacle defining at least a portion of the SSP conduit and sized to receive a sealing device that flows thereinto via the tubular conduit during a well completion operation;

a sealing device seat defining at least a portion of the SSP conduit, wherein the sealing device seat is defined within the sealing device receptacle and is shaped to form a fluid seal with the sealing device and to selectively restrict fluid outflow from the tubular conduit into the subterranean formation, via the SSP conduit, when the sealing device forms the fluid seal therewith; and a sealing device retainer configured to retain the sealing device within the sealing device receptacle while also permitting the sealing device to be unseated from the sealing device seat, wherein the sealing device retainer and the SSP conduit collectively are configured to selectively permit fluid inflow from the subterranean formation into the tubular conduit when the sealing device is retained within the sealing device receptacle and unseated from the sealing device seat.

2. The SSP of claim 1, wherein the sealing device retainer is configured to permit the sealing device to be unseated from the sealing device seat and reseated with the sealing device seat a plurality of times while retaining the sealing device within the sealing device receptacle.

3. The SSP of claim 2, wherein the sealing device is unseated from the sealing device seat responsive to a pressure on the formation-facing region of the SSP being greater than a pressure on the conduit-facing region of the SSP, and further wherein the sealing device is seated on the sealing device seat responsive to the pressure on the conduit-facing region of the SSP being greater than the pressure on the formation-facing region of the SSP.

4. The SSP of claim 1, wherein the sealing device receptacle includes an aperture, which is defined within the conduit-facing region of the SSP, and further wherein the sealing device retainer projects at least partially across the aperture.

5. The SSP of claim 1, wherein the sealing device retainer is biased to permit motion of the sealing device into the sealing device receptacle and to resist motion of the sealing device out of the sealing device receptacle.

6. The SSP of claim 1, wherein the sealing device retainer is formed from at least one of:

(i) a soluble material configured to dissolve within a wellbore fluid that extends within the tubular conduit;

(ii) is a corrodible material configured to be corroded by the wellbore fluid;

(iii) an insoluble material that does not dissolve within the wellbore fluid; and (iv) a non-corrosive material that is not corroded by the wellbore fluid.

7. The SSP of claim 1, wherein the sealing device retainer is configured to permit the sealing device to flow from the tubular conduit and past the sealing device retainer into engagement with the sealing device seat and to resist flow of the sealing device from the sealing device receptacle into the tubular conduit.

8. The SSP of claim 1, wherein the SSP further includes:

an isolation device extending within the SSP conduit and configured to selectively transition from a closed state, in which the isolation device restricts fluid flow through the SSP conduit, to an open state, in which the isolation device permits fluid flow through the SSP conduit, responsive to a shockwave, within a wellbore fluid extending within the tubular conduit, that has greater than a threshold shockwave intensity; and a retention device configured to retain the isolation device in the closed state prior to receipt of the shockwave that has greater than the threshold shockwave intensity.

9. The SSP of claim 1 in combination with the sealing device, wherein the sealing device is positioned within the sealing device receptacle, and further wherein the sealing device retainer retains the sealing device within the sealing device receptacle.

10. The SSP of claim 9, wherein the sealing device is formed from at least one of:

(i) a soluble material configured to dissolve within a wellbore fluid that extends within the tubular conduit; and (ii) is a corrodible material configured to be corroded by the wellbore fluid.

11. The SSP of claim 1, wherein the SSP further includes a channel shaped to permit the fluid inflow past the sealing device retainer when the sealing device is received within the sealing device receptacle.

12. The SSP of claim 1, wherein the sealing device seat has a preconfigured geometry established prior to the tubular conduit being installed within the subterranean formation.

13. The SSP of claim 1, wherein the sealing device seat is at least one of:

(i) an erosion-resistant sealing device seat configured to resist erosion by particulate material, which is present within a wellbore fluid, during flow of the wellbore fluid through the sealing device seat; and (ii) a corrosion-resistant sealing device seat configured to resist corrosion by the wellbore fluid during fluid contact between the sealing device seat and the wellbore fluid.

14. A wellbore tubular including the SSP of claim 1.

15. The wellbore tubular of claim 14, wherein the wellbore tubular includes a projecting region that projects from an external surface of the wellbore tubular, and further wherein the SSP is positioned within the projecting region.

16. The wellbore tubular of claim 15, wherein the projecting region includes a centralizer wing.

17. A hydrocarbon well, comprising:

a wellbore tubular defining a tubular conduit and extending within a wellbore that extends within a subterranean formation; and a plurality of the SSPs of claim 1, wherein each SSP of the plurality of SSPs is operatively attached to the wellbore tubular such that a corresponding conduit-facing region faces toward the tubular conduit and also such that a corresponding formation-facing region faces toward the subterranean formation.

18. A method of stimulating a hydrocarbon well, wherein the hydrocarbon well includes a wellbore tubular defining a tubular conduit and extending within a wellbore that extends within a subterranean formation, and further wherein a plurality of selective stimulation ports (SSPs) is spaced-apart along a length of the wellbore tubular, the method comprising:

pressurizing the tubular conduit with a stimulant fluid;

opening a selected SSP of the plurality of SSPs to permit fluid flow from the tubular conduit and into the subterranean formation via an SSP conduit of the selected SSP;

flowing a first volume of the stimulant fluid into the subterranean formation via the SSP conduit to stimulate a first region of the subterranean formation;

releasing a sealing device within the tubular conduit;

receiving the sealing device within a sealing device receptacle of the selected SSP;

retaining the sealing device within the sealing device receptacle with a sealing device retainer of the selected SSP;

seating the sealing device on a sealing device seat of the selected SSP to resist a fluid outflow of the stimulant fluid from the tubular conduit into the subterranean formation via the SSP conduit; and repeating the pressurizing, the opening, the flowing, the releasing, the receiving, the retaining, and the seating a plurality of times, via the plurality of SSPs, to stimulate a plurality of subsequent regions of the subterranean formation; and thereafter unseating the sealing device from the seating on the sealing device seat to permit fluid inflow from the subterranean formation into the tubular conduit when the sealing device is retained within the sealing device receptacle and unseated from the sealing device seat.

19. The method of claim 18, wherein, subsequent to the repeating, the method further includes producing a reservoir fluid from the subterranean formation, wherein the producing includes permitting a fluid inflow of the reservoir fluid, via a plurality of SSP conduits of the plurality of SSPs, while retaining a respective sealing device within a respective sealing device receptacle of each SSP of the plurality of SSPs with a corresponding sealing device retainer of each SSP of the plurality of SSPs, and further wherein, subsequent to the producing, the method further includes repeating the pressurizing to seat a plurality of sealing devices on a corresponding plurality of sealing device seats.

20. The method of claim 19, wherein the retaining includes retaining during both the producing and during the repeating the pressurizing.

21. The method of claim 19, wherein the method includes sequentially repeating the pressurizing and the producing a plurality of times while retaining the plurality of sealing devices within a corresponding plurality of sealing device receptacles.

22. The method of claim 18, wherein, subsequent to the repeating, the method further includes waiting at least a threshold dissolution time to permit a respective sealing device, which is associated with each SSP of the plurality of SSPs, to at least one of dissolve and corrode, thereby being released from a respective sealing device receptacle, and further wherein, subsequent to the waiting, the method further includes producing a reservoir fluid from the subterranean formation.

23. A method of conveying a downhole tool within a hydrocarbon well, wherein the hydrocarbon well includes a wellbore tubular defining a tubular conduit and extending within a wellbore, and further wherein a plurality of selective stimulation ports (SSPs) are spaced-apart along a length of the wellbore tubular, the method comprising:

restricting fluid flow through each SSP in the plurality of SSPs with a respective sealing device, wherein the restricting includes receiving the respective sealing device within a respective sealing device receptacle and on a respective sealing device seat of each SSP during a well completion operation;

retaining the respective sealing device within the respective sealing device receptacle with a respective sealing device retainer of each SSP;

establishing fluid communication between the subterranean formation and a downhole region of the tubular conduit;

positioning the downhole tool within an uphole region of the tubular conduit;

providing a conveyance fluid to the tubular conduit; and pumping the downhole tool in a downhole direction via flow of the conveyance fluid within the tubular conduit; and thereafter unseating the sealing device from the seating on the sealing device seat to permit fluid inflow from the subterranean formation into the tubular conduit when the sealing device is retained within the sealing device receptacle and unseated from the sealing device seat.

* * * * *